United States Patent [19]

Shumway et al.

[11] Patent Number: 4,512,881

[45] Date of Patent: Apr. 23, 1985

[54] MACHINE FOR RECOVERING PRECIOUS METAL VALUES FROM ORE

[76] Inventors: Merwin S. Shumway, 558 W. 400 North; Earl D. Shumway, P.O. Box 237, both of Blanding, Utah 84511

[21] Appl. No.: 537,743

[22] Filed: Sep. 30, 1983

[51] Int. Cl.[3] ..... B03B 5/56

[52] U.S. Cl. ..... 209/270; 209/294; 209/452

[58] Field of Search ..... 209/270, 293, 294, 298, 209/299, 450–452

[56] References Cited

U.S. PATENT DOCUMENTS

| | | | |
|---|---|---|---|
| 1,187,927 | 6/1916 | Ramsey | 209/43 X |
| 1,387,238 | 8/1921 | Cave | 209/270 |
| 2,208,092 | 7/1940 | Addis | 209/452 |
| 2,215,818 | 9/1940 | Lindequist | 209/270 |
| 2,288,742 | 7/1942 | Ransohoff | 209/270 X |
| 2,331,135 | 10/1943 | Overstrud | 209/17 X |
| 2,599,402 | 6/1952 | Lindsey | 209/270 X |
| 2,711,824 | 6/1955 | Ehrler | 209/298 |
| 2,838,177 | 6/1958 | Higgin | 209/293 X |
| 4,159,242 | 6/1979 | Walker | 209/270 X |
| 4,347,130 | 8/1982 | Younge | 209/452 |

FOREIGN PATENT DOCUMENTS

| | | | |
|---|---|---|---|
| 61649 | 5/1892 | Fed. Rep. of Germany | 209/294 |

*Primary Examiner*—Robert Sptizer

*Attorney, Agent, or Firm*—M. Ralph Shaffer

[57] ABSTRACT

A machine for wet-processing ore to recover precious metal values such as gold. The machine includes a rotating, inner, perforate, hollow, ore-receiving drum and also a vibrating cradle for receiving water, sands, and other relatively fine material as is discharged through the perforations of such drum. The drum is provided with an inner spiral protuberance for advancing materials from the receiving to the discharge end thereof. Additionally, impact means as are disposed between turns of such spiral are employed to advance rapidly, larger materials such as rocks and coarse gravel through the drum. The cradle is provided with an auger for discharging materials from the cradle; said cradle is so designed and positioned as to concentrate finer materials such as gold-containing black sand, proximate a lowered, reservoir-end thereof for discharge.

1 Claim, 8 Drawing Figures

MACHINE FOR RECOVERING PRECIOUS METAL VALUES FROM ORE

FIELD OF INVENTION

The present invention relates to machines for processing ore and, more particularly to a revolving drum type machine whereby fine materials as might contain nugget, flake and flour-type gold may be gathered and conveniently discharged.

BACKGROUND

The present invention is directed to recovering gold for other precious metal values from placer deposits. Such deposits will generally occur downstream from hardrock deposits known as lodes. Placer deposits may exist where the carrying power of a stream is gradually reduced as in the case of sand and gravel bars, or at low points or pockets in a streambed. "Creek placers" are gravel deposits in the beds and/or intermediate flood plains of small streams. "Bench placers" may exist anywhere from a few feet to several hundred feet above present streams. Hillside placers will lie between creek and bench placers and are considered alluvial-type placers. Other placers may exist at river bars or gravel plains or even along sea beaches. Black sands found in such placer deposits frequently are often indicative of the presence of gold, particularly gold in flake or flour form. Black sands may also include iron oxides, chromite, and other materials. These black sands are frequently heavier than other types of ore materials and easily and quickly sink to the bottom of a water bath. Prospectors frequently look for black sand deposits, since among such deposits the presence of gold is frequently detected.

BRIEF DESCRIPTION OF PRIOR ART

Recovery of placer gold frequently involves the employment of countercurrent systems, ridged movable belts and other types of separating means. No prior art is currently known which employs a revolving drum and cradle technique as is practiced in the present invention. Likewise, no patents are currently known which teach the employment of such structure in a machine for recovering gold or other precious metal values.

BRIEF DESCRIPTION OF PRESENT INVENTION

According to the present invention, a perforate hollow drum is revolved about its axis and designed to receive ore materials, with a water spray, in an inlet end, and discharge coarse materials at a discharge end thereof. An interior spiral protuberance is provided for gradually advancing materials at the bottom of the drum from the receiving end to the discharge end thereof. Impact means are mutually spaced between adjacent spirals so as to impact against larger objects such as rock and large-sized gravel so that these may be rapidly expelled from the drum.

Disposed beneath such perforate drum is a receiving means such as a cradle or shell that is vibrated laterally and provided with an auger. Accordingly, materials as are dropped through the perforations of the drum will find their way in the cradle and will be advanced in a reverse direction, i.e., away from the water-containing lowered end of the cradle, to the outlet end thereof, the latter being proximate but beneath the discharge end of the drum aforementioned. Sufficient spacing is provided between the auger and the lower portion of the cradle so as to allow for the settling out of black sand and heavy precious metal values in received materials. The reservoir end of the cradle is provided with valving means for selectively discharging contents for further test, assay processing. The discharge end of the drum is provided with mutually spaced bars which further aid in expelling rocks from such end through the spaces between such bars. The machine is designed so that a minimum power requirement, for driving the drum and agitating the cradle, is needed.

OBJECTS

Accordingly, a principal object of the present invention is to provide a new and improved machine for processing ore containing precious metal values.

A further object of the invention is to provide a perforated drum and cradle combination designed to take advantageous separating black sand materials from feed ore.

A further object is to provide a laterally vibrating cradle or shell structure for receiving materials dropped by a revolving perforated drum, this in a manner such that fines may be captured and concentrated in a water-reservoir portion of the cradle, with remaining materials being expelled from such cradle.

An additional object is to provide a revolving drum containing a spiral and also impact means, whereby to facilitate the passage of ore through such drum as to unwanted oversized materials, desired materials being permitted to pass through perforations of such drum for further processing.

BRIEF DESCRIPTION OF DRAWINGS

The present invention, together with further objects and advantages thereof, may best be understood by reference to the following drawings in which.

DETAILED DESCRIPTION OF PREFERRED EMBODIMENTS

Figures 1, 1A, 6, 7:
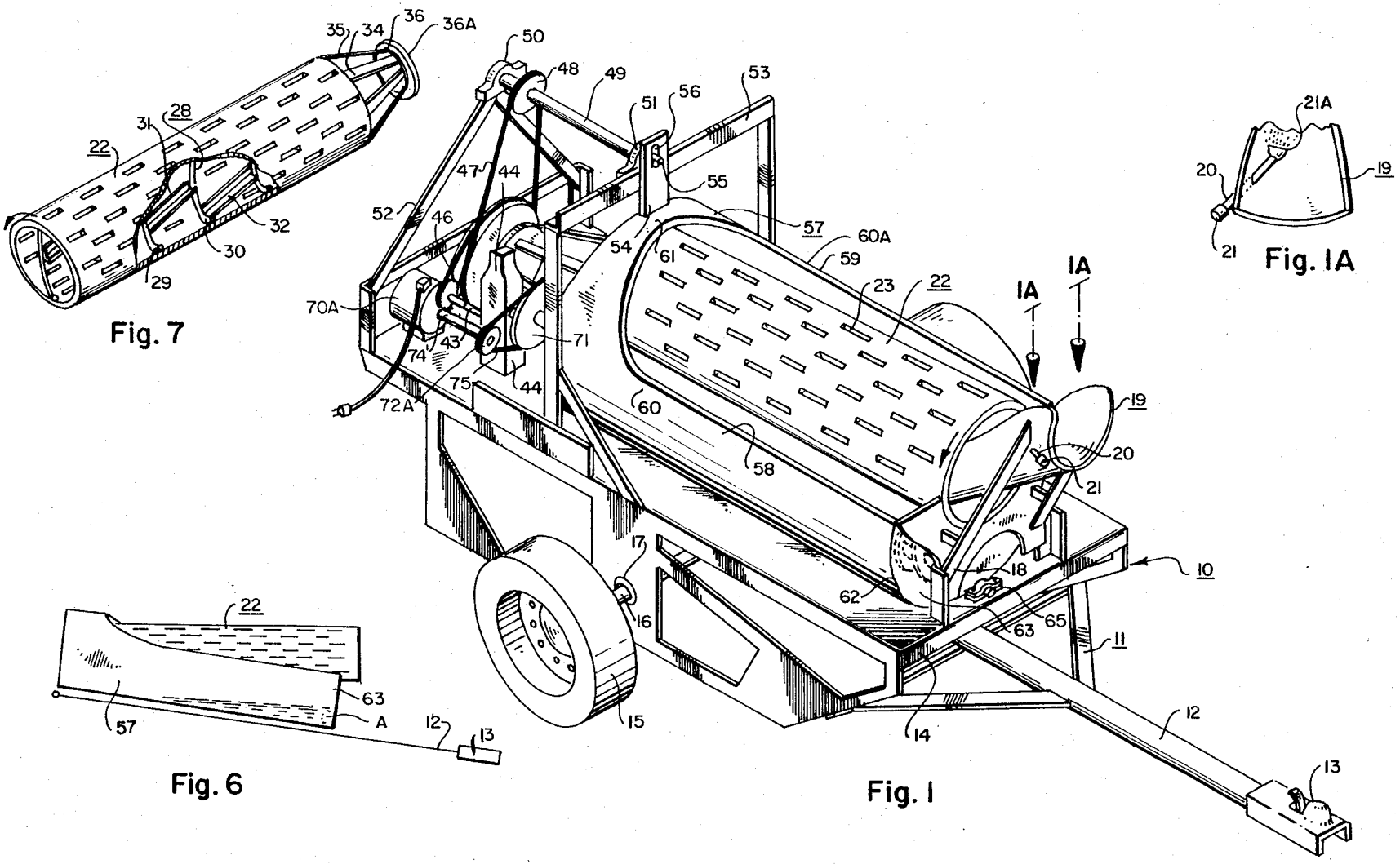
FIG. 1 is a perspective view of a precious metal values recovery unit constructed in accordance with the features of the present invention in one embodiment thereof.
FIG. 1A—1A is a slightly enlarged, fragmentary plan view taken along the line 1A—1A in FIG. 1.
FIG. 6 is a side elevation, in schematic form of the essential structure of FIG. 2 when a draw bar attached thereto is in declining orientation.
FIG. 7 is a perspective view, partially broken away, of the revolving drum of FIG. 1.
Figure 3:
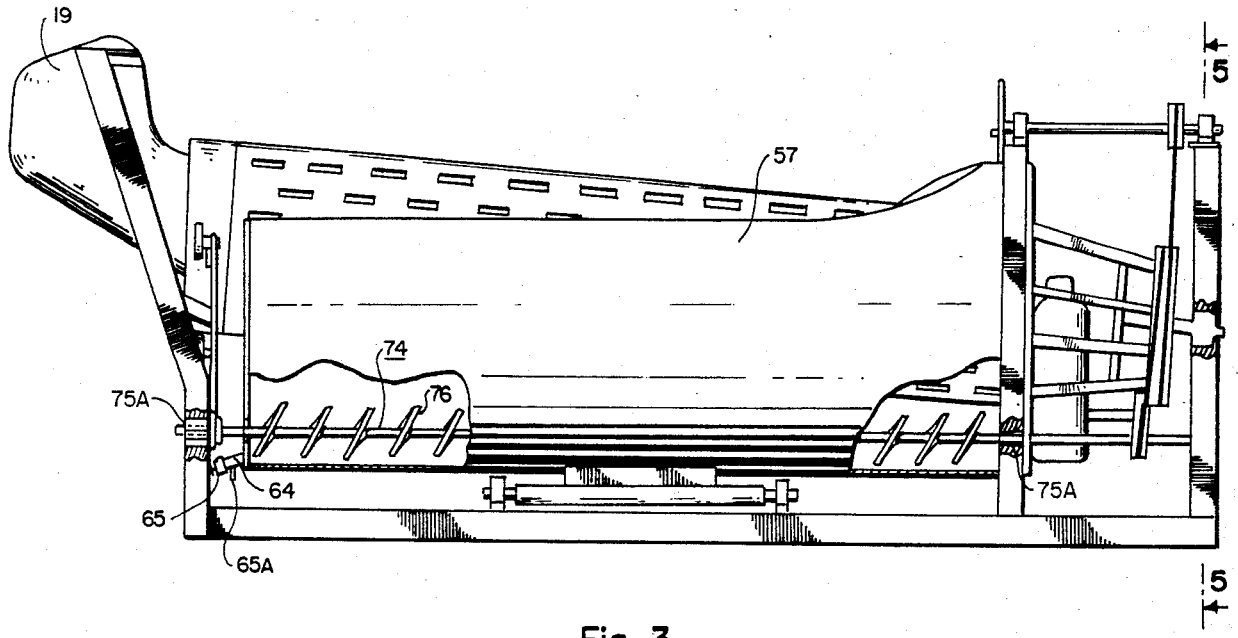
FIG. 3 is a reverse side elevation of the structure of FIG. 1, showing the ends reversed.

In FIG. 1 the unit 10 is shown to include a trailer which may be standard in design. The trailer is designated as 11 and includes the conventional drawbar 12 and trailer hitch 13 of standard design. Trailer 11 will include the standard trailer frame 14 which is supported by wheels 15 at opposite sides of the structure, such wheels being keyed to axle 16 journalled in opposite side bearing 17. The trailer will have a series of support structures such as support structure 18 that is welded to a hopper 19 that can simply comprise a funnel or chute. Hopper 19 includes a spray inlet conduit 20 having suitable hose connection 21 and also a spray head 21A The spray head will be directed inwardly and be oriented preferably toward the side of a perforate hollow drum 22, the latter having a series of preferably elongated apertures 23 mutually space about the periphery of such drum.

Drum 22 is supported by rollers 24 which are journalled to pins 25 affixed to support plate structure 26. The latter has opposite braces 27 which are welded to and upstanding from the trailer frame 14. This supporting structure at forward or feed end of the drum is designed, of course, to accommodate the revolvement of such drum about its longitudinal central axis. Interior of the drum is a spiralled rod 28 fixed thereto and extending between the drum's ends. This spiralled rod or protuberance 28 includes a series of turns adjacent ones 29 and 30 of which will receive a series of impact members or means 31, 32 angulated in position and secured to such drum so as to aid in the impacting and rapid movement of the large rocks and large-sized gravel toward the discharge end of the drum. These impact members will be staggered about the interior of the drum, disposed between adjacent turns, and be positioned in angulated securement relative to the drum to accomplish the function intended. Two such impact members 31, 32 are indicated relative to FIG. 7.

Figure 2:
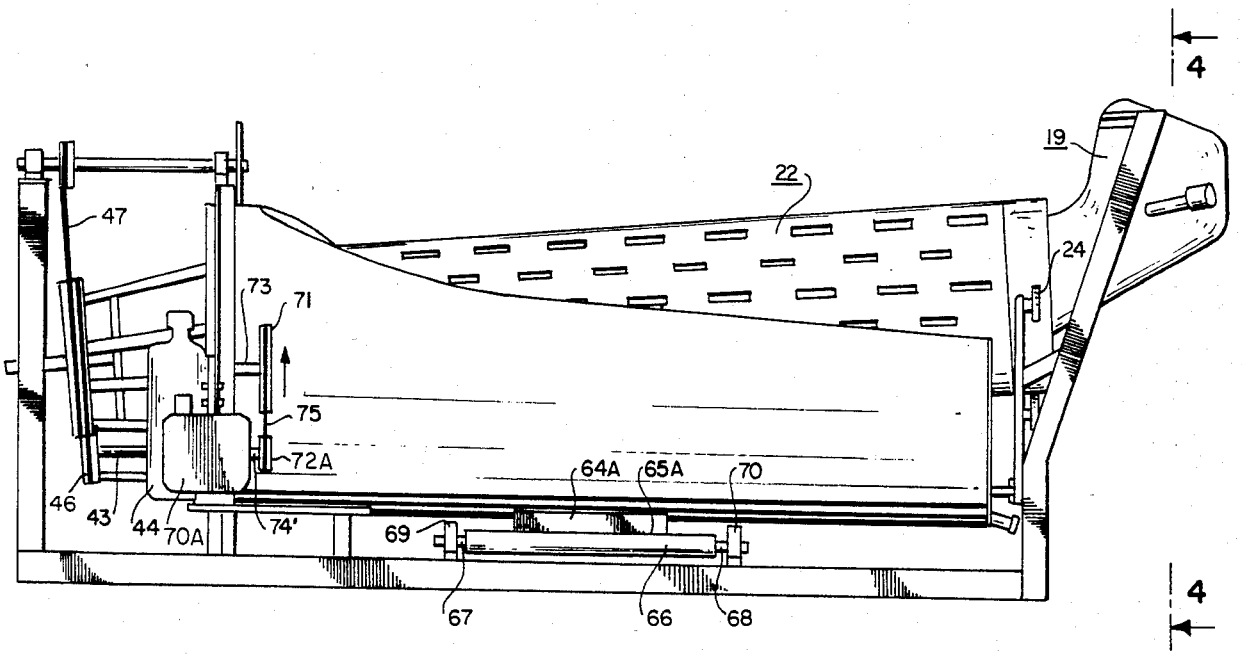
FIG. 2 is a side view of the structure shown in FIG. 1.
Figure 4:
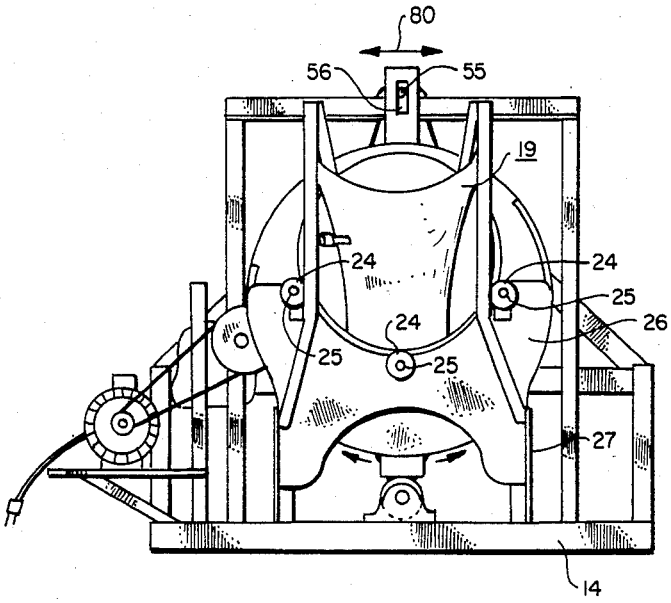
FIG. 4 is an end elevation taken along the line 4—4 in FIG. 2.
Figure 5:
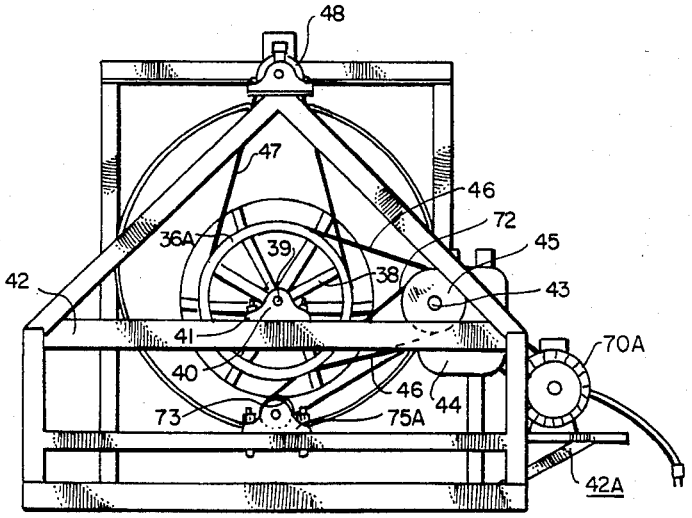
FIG. 5 is an end elevation taken along the line 5—5 in FIG. 3.

The discharge end of the drum is provided with a series of mutually spaced bars 34, 35, etc., which are welded at their nearmost ends to the discharge end edge of the drum and which are welded or otherwise secured at their remaining end to a coaxial disk 36. Where desired, the disk may be a separate part; alternatively, pulley 36A may be attached to/or employed in lieu of the disk 36 and be used for both supporting and also revolving such drum 22. In FIG. 5 the disk 36A forms the pulley and receives pulley belt 46 effectively driving the same. The pulley may include spokes 38 welded to a common hub and which receives shaft 39 journalled in pillowblock bearing 40. Suitable attachments at 41 may be used to secure the pillowblock bearing 40 to crossbar 42. Crossbar 42 will form an integral part of the frame 42A upstanding from the trailer frame and being secured thereto. Electric motor 70A includes an output shaft 74' to which pulley 72A is pinned. Pulley 72A is coupled to pulley 71 of shaft 73, comprising the input shaft to gear box 44. The pulley 71 and 72A are intercoupled together by belt 75 which may be of the V-belt type. See FIG. 2 in the above regard. Gear box 44 is a gear-reducing unit wherein the motor is geared down to drive appropriately the drum 22. This is effectuated by means of the output shaft 43 of gearbox 44, the inclusion of pulley 45 thereon, being keyed thereto, and likewise the inclusion of belt 46 which couples pulley 45 to pulley 36A. Pulley 36A will be of sufficient width to accomplish the mounting of an additional belt drive, i.e., belt 47, which is routed to and over pulley 48, see FIGS. 1 and 5. Pulley 48 is pinned to shaft 49 which is journalled by pillow-block bearings 50 and 51 as mounted to shaft support structures 52 and 53. Shaft 49 includes a forward eccentric pin 55 disposed within pin guide channel or slot 56 operatively associated with actuator block 54. Block 54 is welded at its lower edge to the upper portion 61 of cradle 57. Cradle 57, if desired, may be fabricated from conventional well casing and will include upper, opposite side edges 58 and 59 for opposite sides 60 and 60A. Upper portion 61 is integral with the opposite sides, of course, and will provide a suitable mount for the actuator block 54. Again, belt 47 will perform and drive coupling from pulley wheel 36A and pulley 48. Cradle 57, of course, forms a receiving means for receiving fine materials and water as is dropped through the perforations relative to drum 22. Cradle 57 includes an upper open end and also a lower end at 62 which is closed by end partition 63. This forms, in machine operation, a lower reservoir end for the accumulation of water, fine sand and other materials, and, hopefully, precious metal values. Such end will be provided with a discharge conduit 64, preferably supplied with a manual on-and-off control valve 65 for regulating discharge of water and gathered fines. Cradle 57 itself will include a bearing block 64A at the bottom thereof which will rest upon bearing roller 66. Where it is intended that the vibration be about the axis of shaft 67, then 65A will be a weld location relative to the bearing block 64A and roller 66. Roller 66 will have opposite shaft extensions 67 and 68 journalled in fixed bearings 69 and 70 that can be self-aligning. As an alternative, the bearing may simply roll slightly over the roller at surface 65A where this is desired as a suitable construction for the vibratory movement of the upper portion of the cradle. This latter vibratory movement, of course, is effected by the eccentric pin 55 riding inside slot 56. Accordingly, the revolvement of shaft 49 and hence the circular movement of eccentric pin 55 will produce vibrations in accordance with the double-headed arrow 80 in FIG. 4, whereby to effectuate a lateral vibrating of the cradle. Structure 64/64A is used simply to support the bottom of the cradle. The purpose for the vibrating is to ensure that the fines will settle out and descend to the central area of the bottom of the cradle and drift down to the reservoir- or lower end of the cradle for suitable gathering or concentration. The cradle itself will generally be supplied with an auger 74, the latter being journalled in suitable bearings 75A and having a series of auger flights 76. The remaining end of the auger will proceed through the closed end of the cradle and be journaled in any convenient fashion to the support structure. Depending upon the support of the cradle and its mode of vibration, the journalling and packing of the auger relative to end partition 63 may be made fixed or flexible. Indeed, in all of the constructions herein, for convenience of illustration, plural universal joints and other means for appropriately determining the various journalling alignments have been deleted, as these methods are well known in the art.

Shaft 43 of course is the output shaft of the gear box 44, and pulley 75 is secured to such shaft 76 and receives the belt 72 for driving pulley 73 associated with the auger. 75A refers to the journal mounts for the auger shaft.

In operation the motor 70A is energized and operates to turn the drum 22. This turning, of course, is revolvement of the drum about its longitudinal central axis. Vibratory movement of the cradle is likewise effected through the rotation of shaft 49 and eccentric pin 55 riding in slot or channel 56 of actuator block 54. By this structure there is a rapid back and forth lateral vibration effectuated relative to the top of the cradle, such cradle being supported by bearing block 64A and roller 66.

Comminuted ore is introduced into the chute 19 and is mixed with water and fed into the interior of the drum. The spiral and impact means seen in FIG. 7 advance the materials toward the discharge end of the drum. It is noted as per FIG. 6 that the drum 22 will be angled downwardly from the feed end to the discharge end whereas a reverse angulation or decline will exist relative to the cradle. Accordingly, the heighth of the tongue of the trailer at 12 in FIG. 6 can be controlled and regulated by a hydraulic jack or other means, not shown. Thus, coarse materials proceed out of the drum and drop between the spaced bars 34, 35 in FIG. 7. Fine materials with water proceed through the perforations 23 and enter into the cradle area. The heavier fines will drop out and proceed to the bottom of the vibrating cradle and there gradually congregate to the reservoir or lower end of the cradle proximate A at partition 63. The auger will be operative to urge materials within the cradle above the bottom in a direction toward the upwardly raised discharge end of such cradle. As a consequence of this operation, the auger will in fact be spaced approximately ½" above the bottom surface of the cradle, thereby leaving undisturbed the black sands and gold fines as congregate to the bottom and proceed to the, lower reservoir-end of such cradle.

At desired times, the valve 65 will be opened so as to release concentrated and congregated materials, this for further concentration, assay and processing. Since the black sands which are customarily found in alluvial deposits show high promise of containing gold, the flake or flour gold, and possibly small nuggets, may be found in such black sands and other materials as are permitted to congregate to the bottom of the cradle and to be agitated gradually rearwardly to the reservoir end of such cradle.

Accordingly, what is provided is a new and improved machine for processing ore in a water environment such that the fines, such as small nuggets, flake and flour gold, or other precious metals gathered with such fines for suitable recovery. Where certain drive belts are askew to drive axis, the belts can be chosen to have sufficient flexibility to accomplish slight variation in axial or shaft orientation; alternatively, a universal joint structure can be accomplished so that all pulley drives parallel-aligned.

The subject machine has proven highly useful in recovery of gold assay materials.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. A machine for processing ore to recover precious metal values, said machine including, in combination: an elongate, hollow drum having a series of perforations essentially from end to end; means for introducing water in said drum; means for supporting said drum for axial rotation; means for revolving said drum coupled thereto; elongate means having a reservoir-constructed lowered end and disposed beneath said drum for receiving ore and water droppings from said drum as fall through said perforations; auger means spacedly disposed proximate to and above said receiving means for advancing a portion of said droppings along and out said receiving means away from said lowered end, whereby to leave such precious metal values as exist in said ore, as is so processed by said machine, beneath said auger means and at said reservoir- constructed lowered end of said receiving means, available for discharge recovery; means coupled to said auger means for operationally revolving the same; and means for withdrawing said values coupled to said reservoir constructed lowered end at a lower portion thereof, and wherein said drum has a feed hopper at one end and also a series of mutually spaced conically-arranged bars affixed to the remaining end, and means joining said bars together.

* * * * *